US009989902B2

(12) United States Patent
Tamura

(10) Patent No.: US 9,989,902 B2
(45) Date of Patent: Jun. 5, 2018

(54) IMAGE FORMING APPARATUS AND COMPUTER READABLE MEDIUM STORING PROGRAM

(71) Applicant: Konica Minolta, Inc., Chiyoda-ku, Tokyo (JP)

(72) Inventor: Nobuyasu Tamura, Hachioji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days. days.

(21) Appl. No.: 15/422,495

(22) Filed: Feb. 2, 2017

(65) Prior Publication Data

US 2017/0255143 A1 Sep. 7, 2017

(30) Foreign Application Priority Data

Mar. 2, 2016 (JP) ..... 2016-039512

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS

2013/0209123 A1* 8/2013 Waida ..... G03G 15/205 399/68
2015/0220029 A1* 8/2015 Samei ..... G03G 15/2039 399/69

FOREIGN PATENT DOCUMENTS

JP 2007065313 A 3/2007

* cited by examiner

*Primary Examiner* — Clayton E Laballe
*Assistant Examiner* — Jas Sanghera
(74) *Attorney, Agent, or Firm* — Buchanan Ingersoll & Rooney PC

(57) ABSTRACT

An image forming apparatus includes a fixing member, a pressing member, a heating unit and a controller. The fixing member heats a toner image formed on a sheet. The pressing member presses the sheet onto the fixing member. The heating unit heats the fixing member. The controller controls the heating unit. The sheet is located at the fixing member in a first period and the sheet is not located at the fixing member and the fixing member is located between sheets in a second period. The controller controls the heating unit such that the heating unit heats the fixing member in a first heating pattern in which a heating period does not include the second period or in a second heating pattern in which a heating period includes the second period.

17 Claims, 11 Drawing Sheets

| NUMBER OF SHEET TO BE PRINTED [SHEETS/MINUTE] | SHEET INTERVAL [mm] | CONTROL PERIOD [SECOND] | START | LIGHTING RATE [%] | PRESSING ROLLER TEMPERATURE [°C] |
|---|---|---|---|---|---|
| 40 | 52.5 | 1.5 | ON | 43 | 78 |
| | | | OFF | 49 | 95 |
| 35 | 120.0 | 1.7 | ON | 35 | 99 |
| | | | OFF | 43 | 120 |
| 30 | 210.0 | 2.0 | ON | 29 | 118 |
| | | | OFF | 39 | 142 |

FIG.8A

| NUMBER OF SHEET TO BE PRINTED [SHEETS/MINUTE] | SHEET INTERVAL [mm] | CORRECTION AMOUNT [%] |
|---|---|---|
| 40 | 52.5 | 6 |
| 35 | 120.0 | 8 |
| 30 | 210.0 | 10 |

FIG.8B

| BEFORE CHANGE | | AFTER CHANGE | | LIGHTING TIME CORRECTION AMOUNT [%] |
|---|---|---|---|---|
| NUMBER OF SHEET TO BE PRINTED [SHEETS/MINUTE] | SHEET INTERVAL [mm] | NUMBER OF SHEET TO BE PRINTED [SHEETS/MINUTE] | SHEET INTERVAL [mm] | |
| 40 | 52.5 | 40 | 52.5 | 0 |
| | | 35 | 120.0 | 8 |
| | | 30 | 210.0 | 14 |
| 35 | 120.0 | 40 | 52.5 | -8 |
| | | 35 | 120.0 | 0 |
| | | 30 | 210.0 | 6 |
| 30 | 210.0 | 40 | 52.5 | -14 |
| | | 35 | 120.0 | -6 |
| | | 30 | 210.0 | 0 |

IMAGE FORMING APPARATUS AND COMPUTER READABLE MEDIUM STORING PROGRAM

BACKGROUND OF THE INVENTION

1. Field of the Invention

The present invention relates to an image forming apparatus and a computer readable medium storing a program.

2. Description of Related Art

Conventionally, in some image forming apparatuses, a heater which is a heating unit is not provided on the pressing roller side from the viewpoint of energy saving.

However, sheets which are recording media to be used in an image forming apparatus have various kinds such as a thin paper, a rough paper, a coated paper and a thick paper. It is necessary to control the temperature of the pressing roller to maintain the quality of image formed on these papers.

Therefore, there is an image forming apparatus which does not perform a temperature control between sheets (hereinafter referred to as "sheet interval") and which heats the pressing roller in a sheet interval and adjusts the temperature of the pressing roller to suppress the curling of a sheet and an improper fixing (refer to JP 2007-065313A).

However, in the image forming apparatus described in JP 2007-065313A does not turn on a heater in a sheet interval to perform temperature control, in a configuration in which a fixing belt is stretched around a fixing roller and a heating roller having a heater, there is a problem that the temperature of the fixing belt fluctuates and results in a defect such as uneven brightness.

Also, even in a configuration in which a fixing roller and a pressing roller are directly pressed to each other, since the temperature control by turning on a heater is not performed in a sheet interval, there is a problem that a pressing roller is heated more than needed and the temperature of the pressing roller is not able to properly controlled because degree of heat propagation to the pressing roller through a conveyed sheet is different depending on the type of a sheet (for example, a thin sheet or the like).

SUMMARY OF THE INVENTION

The present invention is made considering the circumstances described above. An object of the present invention is to provide an image forming apparatus which can control the temperature of a pressing roller even when there is not a heating unit on the pressing roller side.

To achieve at least one of the objects described above, according to one aspect of the present invention, an image forming apparatus reflecting one aspect of the present invention includes: a fixing member which heats a toner image formed on a sheet; a pressing member which presses the sheet onto the fixing member; a heating unit which heats the fixing member; and a controller which controls the heating unit, wherein the sheet is located at the fixing member in a first period and the sheet is not located at the fixing member and the fixing member is located between a rear edge of a conveyed sheet and a front edge of a next conveyed sheet in a second period, and wherein the controller controls the heating unit such that the heating unit heats the fixing member in a first heating pattern in which a heating period does not include the second period or in a second heating pattern in which a heating period includes the second period.

Preferably, in the image forming apparatus, the controller controls the heating unit such that the heating unit heats the fixing member in the first heating pattern or in the second heating pattern in accordance with a type of the sheet.

Preferably, in the image forming apparatus, the image forming apparatus further includes a temperature measurement unit which measures a temperature of the heating unit, wherein the controller controls the heating unit such that the heating unit heats the fixing member in the first heating pattern or in the second heating pattern in accordance with the temperature measured by the temperature measurement unit.

Preferably, in the image forming apparatus, the first heating pattern is a heating pattern in which a heating period is set so as to perform heating from a time point when a front edge of the sheet arrives at the fixing member at a beginning of a control period composed of the first period and the second period, and the second heating pattern is a heating pattern in which a heating period is set so as to perform heating at an end of the control period.

Preferably, in the image forming apparatus, the first heating pattern is a heating pattern in which a heating period is set so as to perform heating from a time point when a front edge of the sheet arrives at the fixing member at a beginning of a control period composed of the first period and the second period, and the second heating pattern is a heating pattern in which a heating period is set so as to perform heating from a time point when a rear edge of the sheet arrives at the fixing member.

Preferably, in the image forming apparatus, when the controller performs switching of the beginning of the heating period from the time point when a front edge of the sheet arrives at the fixing member to the time point when a rear edge of a sheet arrives at the fixing member, or from the time point when a rear edge of a sheet arrives at the fixing member to the time point when a front edge of a sheet arrives at the fixing member, the controller skips the heating period just after the switching.

Preferably, in the image forming apparatus, the heating period is a period which lasts an integral multiple of the control period or a specified fraction of an integer of the control period.

Preferably, in the image forming apparatus, the image forming apparatus includes a fixing belt stretched around the fixing member and the heating unit, wherein the controller matches a position of the fixing belt where heating is started with a timing when the sheet is pressed between the fixing member and the pressing member.

Preferably, in the image forming apparatus, when the controller changes a set position of the heating period while fixing is performed, the controller compensates a change of the heating period.

Preferably, in the image forming apparatus, the image forming apparatus further includes an adjusting unit which adjusts a conveyance interval between sheets, wherein the controller changes a duration of the second period by controlling the adjusting unit.

Preferably, in the image forming apparatus, when the controller changes the duration of the second period while fixing is performed, the controller compensates a change of the heating period.

To achieve at least one of the objects described above, a non-transitory computer readable medium storing a program reflecting one aspect of the present invention makes a computer of an image forming apparatus function as a controller, the image forming apparatus including a fixing member which heats a toner image formed on a sheet; a pressing member which presses the sheet onto the fixing member; and a heating unit which heats the fixing member, wherein the sheet is located at the fixing member in a first period and the sheet is not located at the fixing member and the fixing member is located between a rear edge of a conveyed sheet and a front edge of a next conveyed sheet in a second period, and wherein the controller controls the heating unit such that the heating unit heats the fixing member in a first heating pattern in which a heating period does not include the second period or in a second heating pattern in which a heating period includes the second period.

Preferably, in the computer readable medium storing the program, the program makes the computer function as the controller which controls the heating unit such that the heating unit heats the fixing member in the first heating pattern or in the second heating pattern in accordance with a type of the sheet.

Preferably, in the computer readable medium storing the program, the image forming apparatus further includes a temperature measurement unit which measures a temperature of the heating unit, and the program makes the computer function as the controller which controls the heating unit such that the heating unit heats the fixing member in the first heating pattern or in the second heating pattern in accordance with the temperature measured by the temperature measurement unit.

Preferably, in the computer readable medium storing the program, the first heating pattern is a heating pattern in which a heating period is set so as to perform heating from a time point when a front edge of the sheet arrives at the fixing member at a beginning of a control period composed of the first period and the second period, and the second heating pattern is a heating pattern in which a heating period is set so as to perform heating at an end of the control period.

Preferably, in the computer readable medium storing the program, the first heating pattern is a heating pattern in which a heating period is set so as to perform heating from a time point when a front edge of the sheet arrives at the fixing member at a beginning of a control period composed of the first period and the second period, and the second heating pattern is a heating pattern in which a heating period is set so as to perform heating from a time point when a rear edge of the sheet arrives at the fixing member.

Preferably, in the computer readable medium storing the program, the heating period is a period which lasts an integral multiple of the control period or a specified fraction of an integer of the control period.

BRIEF DESCRIPTION OF THE DRAWINGS

The present invention will become more fully understood from the detailed description given hereinbelow and the appended drawings which are given by way of illustration only, and thus are not intended as a definition of the limits of the present invention, and wherein:

FIG. 8A is an explanatory view showing an example of correction amount when the position of a heating period is moved;

FIG. 8B is an explanatory view showing an example of lighting time correction amount when the position of the heating period is moved;

DESCRIPTION OF THE PREFERRED EMBODIMENTS

Embodiment

[1. Description of Structure]

Hereinafter, embodiments according to an image forming apparatus of the present invention will be described with reference to the drawings.

Figure 1:
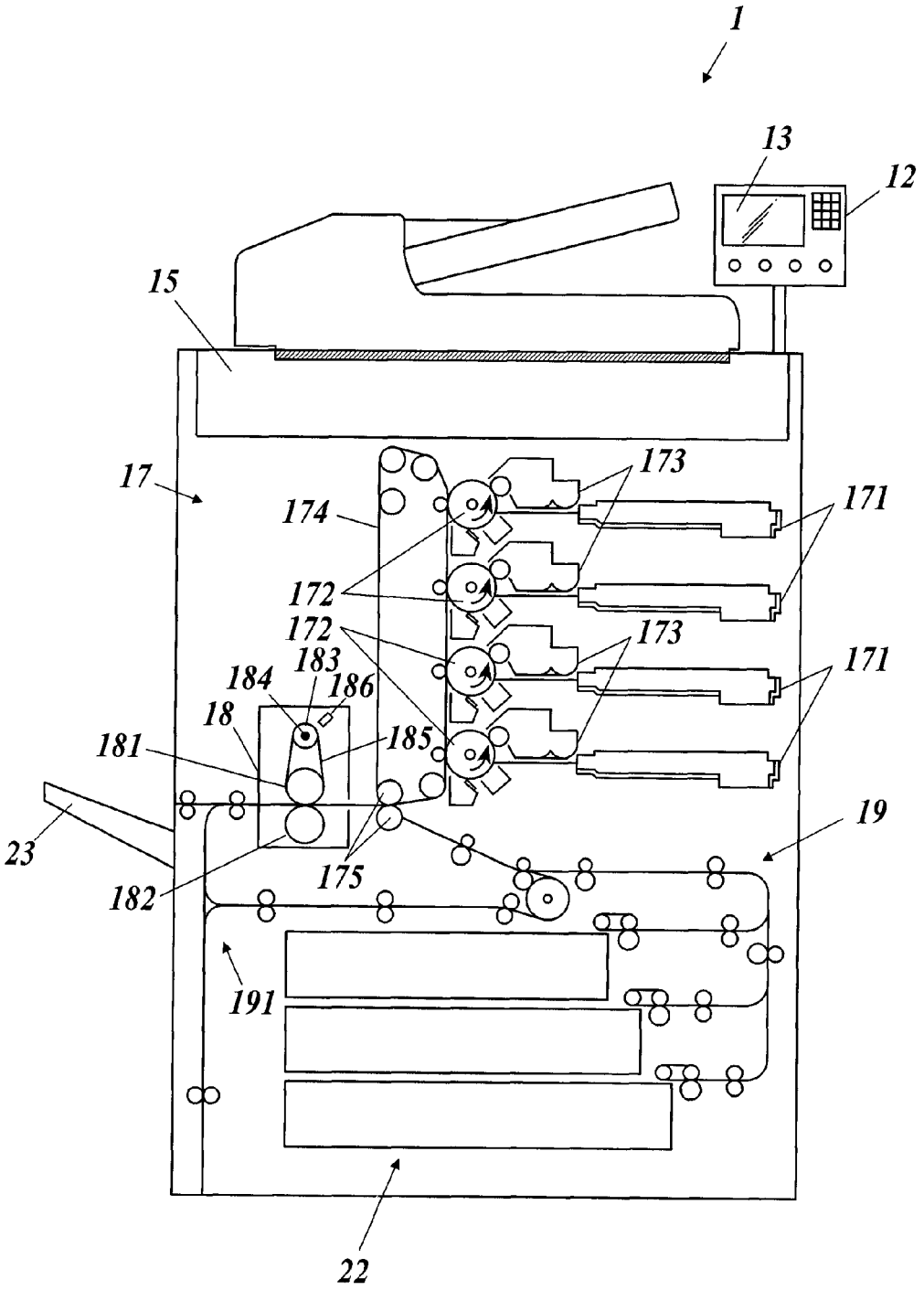
FIG. 1 is a view showing a schematic configuration of an image forming apparatus to which the present invention is applied.
Figure 2:
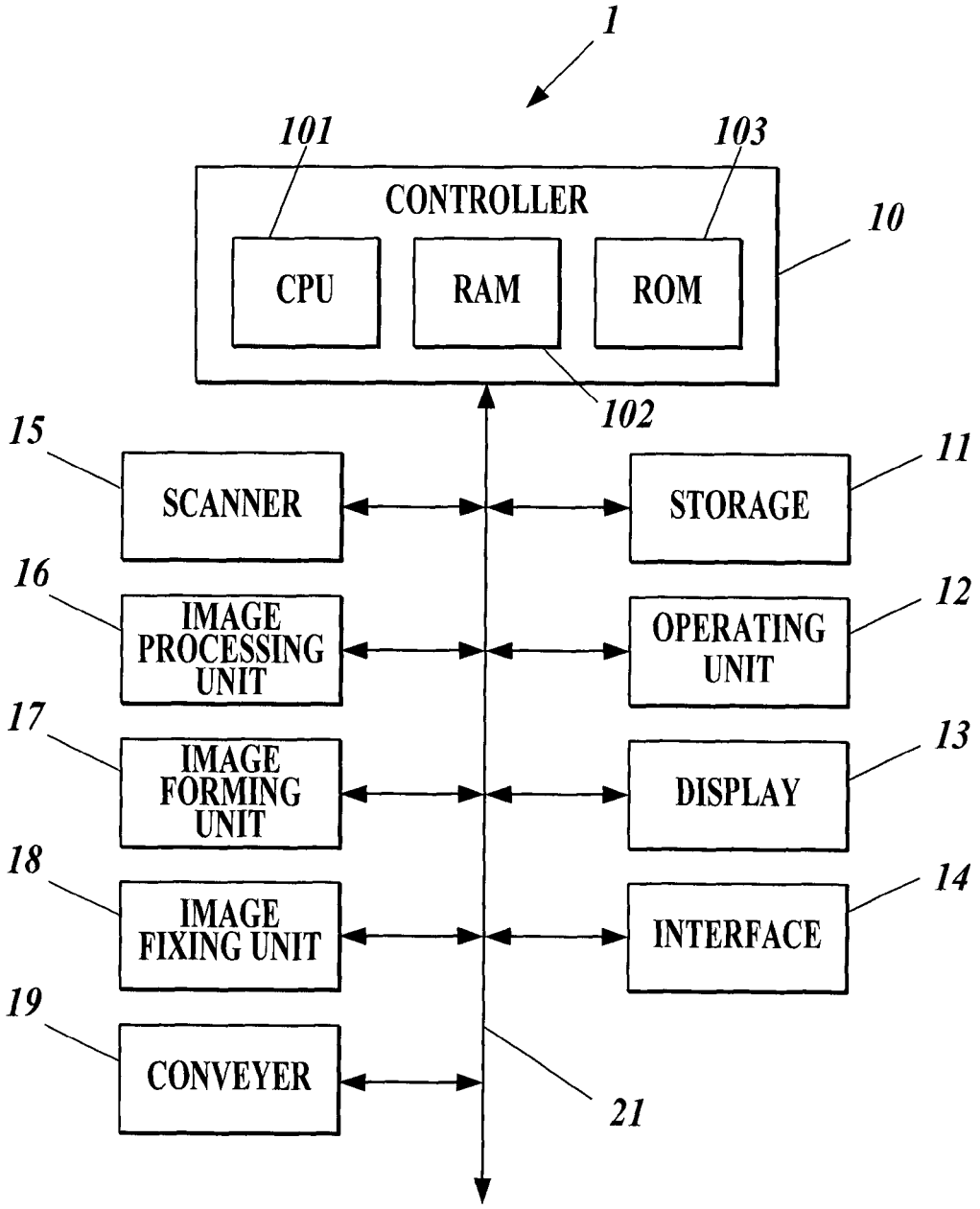
FIG. 2 is a block diagram showing the principal functional configuration of the image forming apparatus.

FIG. 1 is a view showing a schematic configuration of the image forming apparatus 1 according to embodiments of the present invention. FIG. 2 is a block diagram showing the principal functional configuration of the image forming apparatus 1.

The image forming apparatus 1 includes a controller 10 including a CPU (Central Processing Unit) 101, a RAM (Random Access Memory) 102 and a ROM (Read Only Memory) 103, a storage 11, an operating unit 12, a display 13, an interface 14, a scanner 15, an image processing unit 16, an image forming unit 17, an image fixing unit 18, a conveyer 19 and the like. The controller 10 is connected with the storage 11, the operation unit 12, the display 13, the interface 14, the scanner 15, the image processing unit 16, the image forming unit 17, the image fixing unit 18 and the conveyer 19 via a bus 21.

The CPU 101 reads and executes a control program stored in the ROM 103 or the storage 11 to carry out a variety of arithmetic processing.

The RAM 102 provides the CPU 101 with a working memory space and stores temporary data.

The ROM 103 stores a variety of control programs to be executed by the CPU 101, setting data and the like. A rewritable nonvolatile memory such as an EEPROM (Electrically Erasable Programmable Read Only Memory) and a flash memory may be used instead of the ROM 103.

The controller 10 including the CPU 101, the RAM 102 and the ROM 103 carries out the overall control of each part of the image forming apparatus 1 in accordance with the variety of control programs described above. For example, the controller 10 makes the image forming unit 16 perform a predetermined image processing to image data and makes the storage 11 store the resulting image data. Also, the controller 10 makes the conveyer 19 convey a sheet and makes the image forming unit 17 form an image on the sheet based on the image data stored in the storage 11.

The storage 11 is constituted by a DRAM (Dynamic Random Access Memory) which is a semiconductor memory and/or a HDD (Hard Disk Drive), for example. The storage 11 stores image data acquired by a scanner 15, image data input externally via the interface 14 and the like. These image data or the like may be stored in the RAM 102.

The operating unit 12 includes an input device such as operation keys and a touch panel disposed so as to overlap with the screen of the display 13. The operating unit 12 converts the input operation to such an input device to operation signals and outputs to the controller 10.

The display 13 includes a display device such as an LCD (Liquid Crystal Display). The display 13 displays the state of the image forming apparatus 1, an operation screen which shows content of input operation to the touch panel, or the like.

The interface 14 is a unit which transfers data to and receives data from an external computer, another image forming apparatus or the like. The interface 14 is constituted by any one of a variety of serial interfaces, for example.

The scanner 15 scans an image formed on a sheet and generates image data including unicolor image data of each of the color components of R (Red), G (Green) and B (Blue) and makes the storage 11 store the image data.

The image processing unit 16 includes, for example, a rasterization unit, a color conversion unit, a tone correction unit and a halftone processing unit. The image processing unit 16 carries out a variety of image processing to the image data stored in the storage 11 and makes the storage 11 store the resulting image data.

The image forming unit 17 forms an image on a sheet based on the image data stored in the storage 11. The image forming unit 17 includes four sets of an exposure unit 171, a photoreceptor drum 172 and a developing unit 173, the four sets respectively corresponding to color components of C (Cyan), M (Magenta), Y (Yellow) and K (Black). Also, the image forming unit 17 includes a transfer body 174 and secondary transfer rollers 175.

The exposure unit 171 includes an LD (Laser Diode) as a light emitting element. The exposure unit 171 drives the LD based on the image data, emits laser light onto the charged photoreceptor drum 172 to expose the photoreceptor drum 172, and forms an electrostatic latent image on the photoreceptor drum 172. The developing unit 173 supplies toner (color material) of predetermined color (one of C, M, Y and K) onto the exposed photoreceptor drum 172 by a charged developing roller to develop the electrostatic latent image formed on the photoreceptor drum 172.

Images (unicolor images) formed on the four photoreceptor drums corresponding to C, M, Y and K with respective toner of C, M, Y and K are sequentially transferred from each of the photoreceptor drums 172 onto the transfer body 174 so as to be superimposed with one another. In such a way, a color image including the color components of C, M, Y and K is formed on the transfer body 174. The transfer body 174 is an endless belt which is wound around a plurality of transfer body conveyance rollers, and rotates in accordance with the rotations of respective transfer body conveyance rollers.

The secondary transfer rollers 175 transfer the color image on the transfer body 174 onto a sheet which is supplied from a sheet tray 22 or an external sheet feeding device. Specifically, by applying a predetermined transfer voltage between the secondary transfer rollers 175 which sandwich the sheet and the transfer body 174, toner which forms the color image on the transfer body 174 is attracted to the sheet and is transferred onto the sheet.

The image fixing unit 18 carries out a fixing processing to fix toner onto the sheet by heating and pressurizing the sheet on which toner is transferred.

Figure 3:
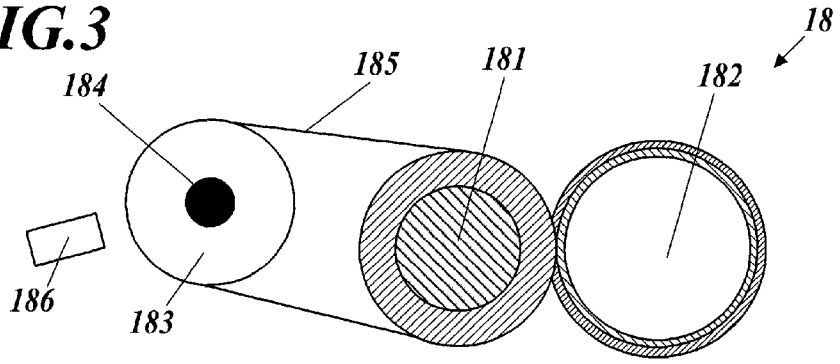
FIG. 3 is a schematic view showing the configuration of the image fixing unit.

FIG. 3 is a schematic view showing the configuration of the image fixing unit 18. The image fixing unit 18 includes a fixing roller 181 which is a fixing member, a pressing roller 182 which is a pressing member, a heating roller 183, a halogen lamp heater 184 which is a heating unit, a fixing belt 185 and a temperature detection unit 186 which is a temperature measurement unit and the like. The image fixing unit 18 and the controller 10 constitute a fixing device.

The heating roller 183 includes the halogen lamp heater 184 which is a fixing lamp (or a fixing heater) extending along the axis of rotation of the heating roller 183. The halogen lamp heater 184 generates heat when electric current is applied under the control of the controller 10.

The fixing belt 185 is stretched around the fixing roller 181 and the heating roller 183. The fixing roller 181 and the pressing roller 182 form a nip where the fixing belt 185 is sandwiched, the nip sandwiching and conveying a sheet.

The fixing roller 181 rotates by being driven by a rotary drive unit such as a motor (not shown) under the control of the controller 10. Instead of the fixing roller 181, the heating roller 183 which operates cooperatively with the fixing roller 181 by the stretched fixing belt 185 may rotate by being driven by a rotary drive unit such as a motor (not shown) under the control of the controller 10.

Furthermore, the heating roller 183 is provided with the temperature detection unit 186 which detects the temperature of the heating roller 183. The single temperature detection unit 186 or a plurality of the temperature detection units 186 may be provided if the temperature of the heating roller 183 can be detected.

As shown in FIG. 3, the pressing roller 182 is biased by an elastic member (not shown) in the direction toward the fixing roller 181, and is pressed against the fixing roller 181 where the fixing belt 185 is sandwiched therebetween. When the fixing roller 181 rotates, the pressing roller 182 rotates while forming a nip between the fixing roller 181 and the pressing roller 182. The pressing roller 182 may rotate by being driven by a rotary drive unit such as a motor (not shown) under the control of the controller 10.

The fixing roller 181 and the pressing roller 182 sandwiches a sheet at the nip, and conveys the sheet in a predetermined direction while heating and pressing the sheet. In such a way, the fixing roller 181 and the pressing roller 182 melts the toner on the sheet and fixes the toner onto the sheet. The fixing roller 181 (fixing belt 185) has a temperature in the range from 180 C.° to 200 C.° when contacting a sheet, for example. Thus, the halogen lamp heater 184 heats the heating roller 183 such that the fixing belt 185 is heated to such a temperature through the heating roller 183.

As shown in FIG. 1, the conveyer 19 includes a plurality of sheet conveyance rollers which convey a sheet by rotating in a state where a sheet is sandwiched therebetween, and conveys a sheet along a predetermined conveyance path. The conveyer 19 includes a turnover mechanism 191 which turns over the front and back of a sheet after the fixing process is carried out by the image fixing unit 18, and which conveys the sheet to the secondary transfer roller 175. In the image forming apparatus 1, in case where images are formed on both sides of a sheet, after the turnover mechanism 191 turns over the front and back of the sheet and images are formed on the both sides of the sheet, the sheet is ejected to a sheet ejection tray 23. When an image is formed on only one side, the turnover mechanism 191 does not turn over the front and back of a sheet and a sheet with an image printed on one of the sides is ejected to the sheet ejection tray 23.

[2. Description of Operation of Image Forming Apparatus]

The operation of the image forming apparatus 1 will be described with reference to the flowchart shown in FIG. 4.

Figure 4:
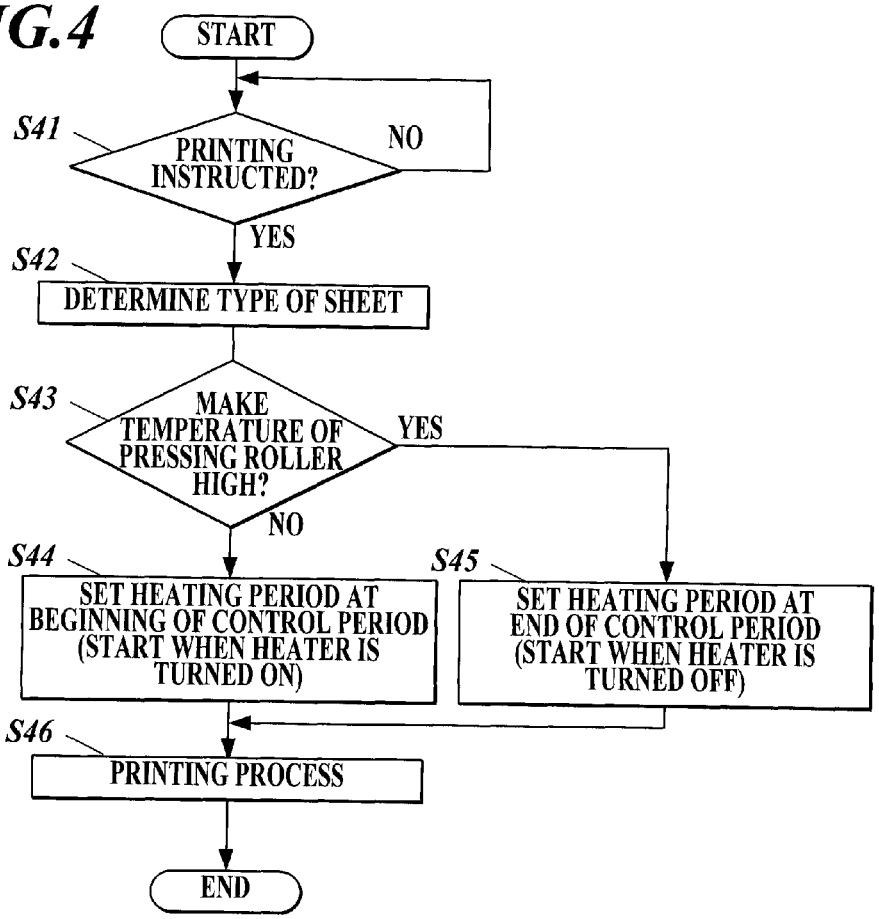
FIG. 4 is a flowchart showing an example of operation of the image forming apparatus.

As shown in FIG. 4, the controller 10 determines whether printing is instructed (Step S41). If the controller 10 determines that printing is not instructed (Step S41: No), the processing returns to Step S41. If the controller 10 determines that printing is instructed (Step S41: Yes), the controller 10 determines the type of a sheet to be conveyed (Step S42).

The controller 10 may determine the type of a sheet to be conveyed based on the information on the selected sheet tray. The controller 10 may determine the type of a sheet to be conveyed by a separate sensor.

The controller 10 determines whether the pressing roller 182 needs to be heated to a high temperature based on the determined type of the sheet (Step S43). For example, when the sheet to be conveyed is a thick paper sheet, the controller 10 determines that the pressing roller 182 needs to be heated to a high temperature because the amount of heat propagating to the pressing roller 182 through the sheet becomes small. On the other hand, for example, when the sheet to be conveyed is a thin paper sheet, the controller 10 determines that the pressing roller 182 does not need to be heated to a high temperature because the amount of heat propagating through the sheet is large.

When the controller 10 determines that the pressing roller 182 does not need to be heated to a high temperature, in other words, when the controller 10 determines that the pressing roller 182 needs to be heated to a low temperature (Step S43: No), the controller 10 sets a heating period at the beginning of a control period (Step S44). On the other hand, when the controller 10 determines that the pressing roller 182 needs to be heated to a high temperature (Step S43: Yes), the controller 10 sets a heating period at the end of the control period (Step S45).

Finally, the controller 10 heats the pressing roller 182 based on the set heating period and carries out a printing process (Step S46).

Figure 5:
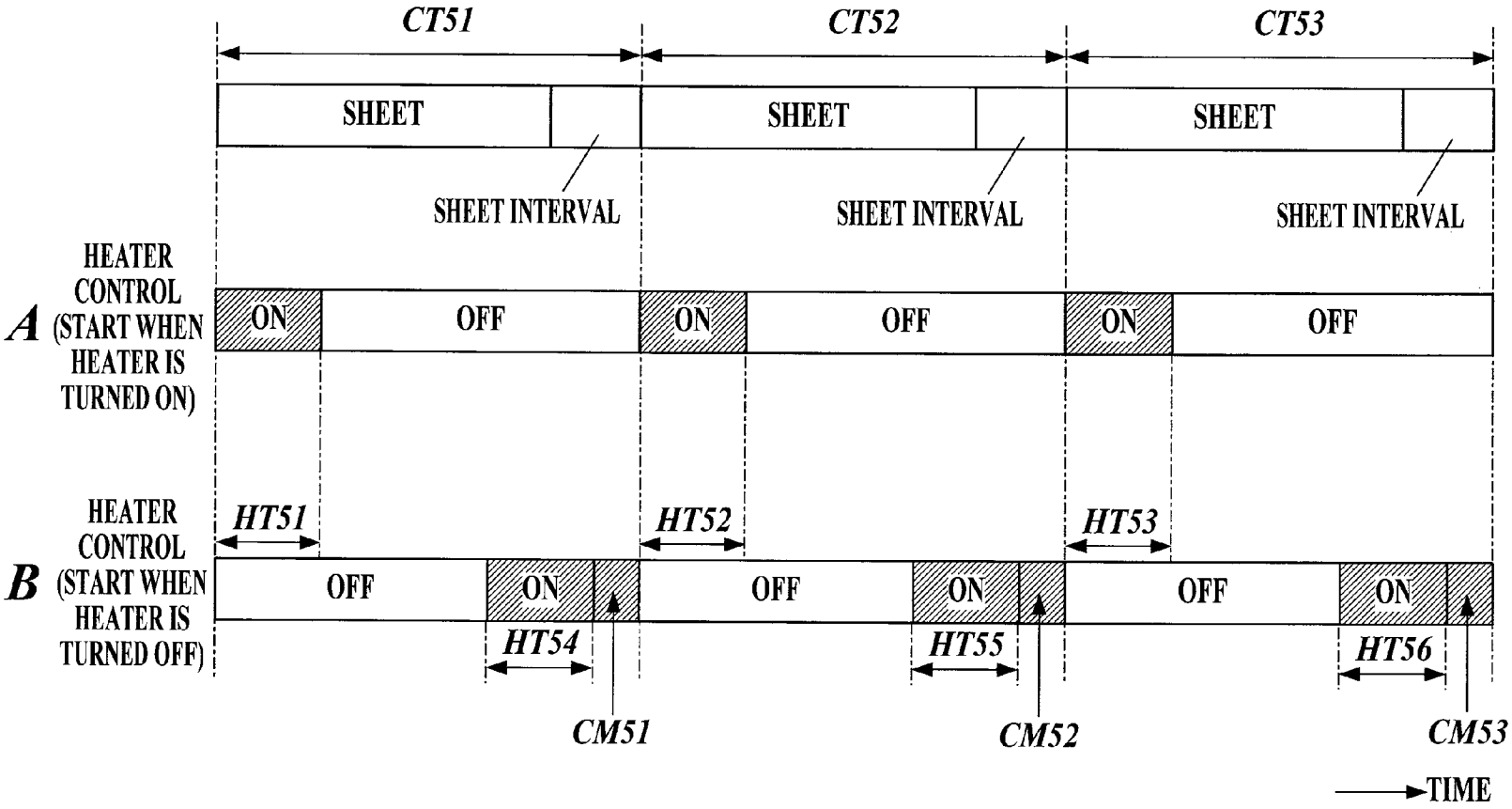
FIG. 5 is an explanatory view showing an example of heating operation of the image fixing unit.

As shown in FIG. 5, a control period is the sum of the period (first period) during which an entire sheet passes through the nip and the period (second period) during which the front edge of the next sheet arrives at the nip (hereinafter this interval is referred to as "a sheet interval"). For example, such control periods are a control period CT51, a control period CT52 and a control period CT53. The front edge of each sheet is matched with the timing of the beginning of each control period.

The heating period is, for example, a period which lasts the integral multiple of the control period or the specified fraction of an integer of the control period. Such heating periods are a heating period HT51, a heating period HT52, a heating period HT53, a heating period HT54, a heating period HT55 and a heating period HT56. For example, in FIG. 5, the heating periods HT51 to HT56 last one fourth of the control periods CT51 to CT53.

That is, as shown in FIG. 5(A), when the heating periods HT51 to HT53 are set at the beginning of the control periods CT51 to CT53, the control periods CT51 to CT53 start when the heating unit is turned ON (the halogen lamp heater 184 is turned on) (hereinafter referred to as "start when the heater is turned ON").

Also, as shown in FIG. 5(B), when the heating periods HT54 to HT56 are set at the end of the control periods CT51 to CT53, the control periods CT51 to CT53 start when the heating unit is turned OFF (the halogen lamp heater 184 is turned off) (hereinafter referred to as "start when the heater is turned OFF").

In the configuration of the image fixing unit 18 as shown in FIG. 3, since a delay occurs by the time when a portion of the fixing belt 185 which is heated by the halogen lamp heater 184 arrives at the nip, the controller 10 needs to match the position of the fixing belt 185 where heating is started with the timing when the front edge of a sheet arrives at the nip. Needless to say, if the fixing roller 181 is configured to include a halogen lamp heater, such a timing adjustment is not necessary.

When the processing starts when the heater is turned OFF, the heating periods HT54 to HT56 cover the entire sheet intervals. Thus, since a part of amount of heat which is necessary to be supplied to a sheet in an expected printing directly propagates to the pressing roller 182 and results in a loss, correction amount CM51, correction amount CM52 and correction amount CM53 are added. The heater lighting time of the halogen lamp heater 184 is extended corresponding to the correction amount.

Figures 6, 7:
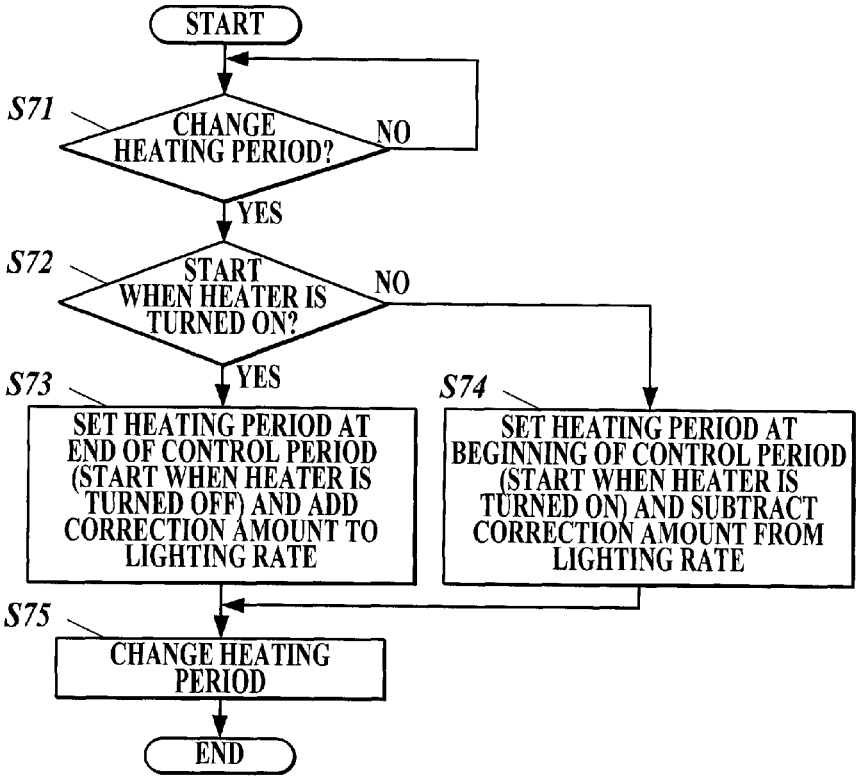
FIG. 6 is an explanatory view showing an example of the temperature of a pressing roller under various conditions.
FIG. 7 is a flow chart showing an example of another operation of the image forming apparatus.

FIG. 6 is an explanatory view showing examples of the temperature of the pressing roller 182 under various conditions including the number of sheets to be printed (sheets/minute), the sheet interval (mm), the control period (second), start when the heater is turned ON and start when the heater is turned OFF.

As is understood from FIG. 6, the temperature of the pressing roller 182 is higher in a case of start when the heater is turned OFF than a case of start when the heater is turned ON when the remaining conditions are the same. Also, the temperature of the pressing roller 182 is higher when the sheet interval is larger since amount of heat which directly propagates to the pressing roller 182 becomes larger.

As described above, in a case of a start when the heater is turned OFF, since the correction amount is added, the lighting rate of the halogen lamp heater 184 in a control period (the heater lighting period in a control period) is larger in comparison to a case of a start when the heater is turned ON. Also, the larger the sheet interval becomes, the larger the correction amount becomes because amount of heat which directly propagates to the pressing roller 182 becomes larger.

As described above, the controller 10 selects a start when the heater is turned ON or a start when the heater is turned OFF in accordance with the type of paper to be conveyed. In other words, by heating in one of a first pattern in which heating is carried out in a heating period which does not include an interval between two sheets and a second pattern in which heating is carried out in a heating period which includes an interval between two sheets, the temperature of the pressing roller 182 is able to be controlled properly.

[3. Description of Other Operations of Image Forming Apparatus]

In the flowchart shown in FIG. 4, the position of a heating period in a control period is selected in accordance with the type of a sheet to be conveyed. That is, it is assumed that the type of sheet is one. However, there is a case where the types of sheet are changed during a sequence of printing processing.

For example, when the sheet to be conveyed is changed from a thick paper sheet to a thin paper sheet, if the heater control before the change (a start when the heater is turned OFF) is maintained, the temperature of the pressing roller 182 becomes too high. FIG. 7 is a flowchart showing an operation in which the position of the heating period in the control period is moved in accordance with the type of paper to be conveyed.

As shown in FIG. 7, the controller 10 determines whether moving the position of the heating period in the control period is necessary in response to the change of the type of sheet to be conveyed (Step S71). If the controller 10 determines that moving the position of the heating period in the control period is not necessary (Step S71: No), the controller 10 returns the processing to Step S71. If the controller 10 determines that moving the position of the heating period in the control period is necessary (Step S71: Yes), the controller 10 determines whether the heater is currently controlled such that the control period starts when the heater is turned ON (Step S71).

If the controller 10 determines that the heater is currently controlled such that the control period starts when the heater is turned ON (Step S72: Yes), the controller 10 moves the heating period to the end of the control period (a start when the heater is OFF) and sets a heater lighting period by adding a correction amount to the heating period (Step S73).

If the heater is currently controlled such that the control period starts when the heater is turned ON, the state shown in FIG. 5(A) is switched to the state shown in FIG. 5(B). The loss occurs resulting from a part of amount of heat which is supposed to directly propagate to the pressing roller 182 and which is necessary to be supplied to a sheet in an expected printing. Such a loss is able to be corrected by respectively adding the correction amount CM51, the correction amount CM52 and the correction amount CM53 to the heating period HT54, the heating period HT55 and the heating period HT56 to change the heater lighting period.

On the other hand, if the controller 10 determines that the heater is not currently controlled such that the control period starts when the heater is turned ON (Step S72: NO), the controller 10 moves the heating period to the beginning of the control period (a start when the heater is turned ON) and subtracts the correction amount from the heating period to change the heater lighting period (Step S74).

If the heater is currently controlled such that the control period does not start when the heater is turned ON, in other words, if the heater is currently controlled such that the control period starts when the heater is turned OFF, the state shown in FIG. 5(B) is switched to the state shown in FIG. 5(A). The heater lighting period is reset to the original heating period HT51, the heating period HT52 and the heating period HT53 by respectively subtracting the correction amount CM51, the correction amount CM52 and the correction amount CM53 from the heater lighting period. Thus, the temperature of the pressing roller 182 is prevented from becoming too high.

FIG. 8A is an explanatory view showing an example of correction amount under various conditions including the number of sheets to be printed (sheets/minute) and the sheet interval (mm). As is understood from FIG. 8A, when the sheet interval is made larger, the correction amount becomes larger because amount of heat which directly propagates to the pressing roller 182 becomes larger.

The controller 10 turns on the halogen lamp heater 184 during the corrected lighting period at the position of the heating period set in the control period (Step S75).

As described above, the controller 10 moves the position of the heating period in the control period and increases or decreases the correction amount with respect to the heating period in accordance with the type of a sheet to be conveyed. In such a way, even if the type of a sheet to be conveyed is changed during printing processing, the temperature of the pressing roller 182 can be properly controlled.

[4. Description of Other Operations of Image Forming Apparatus]

In the flowcharts shown in FIGS. 4 and 7, when the controller 10 determines that the temperature of the pressing roller 182 needs to be made high in accordance with the type of a sheet to be conveyed, the controller 10 sets the heating period at the end of the control period.

Figure 9:
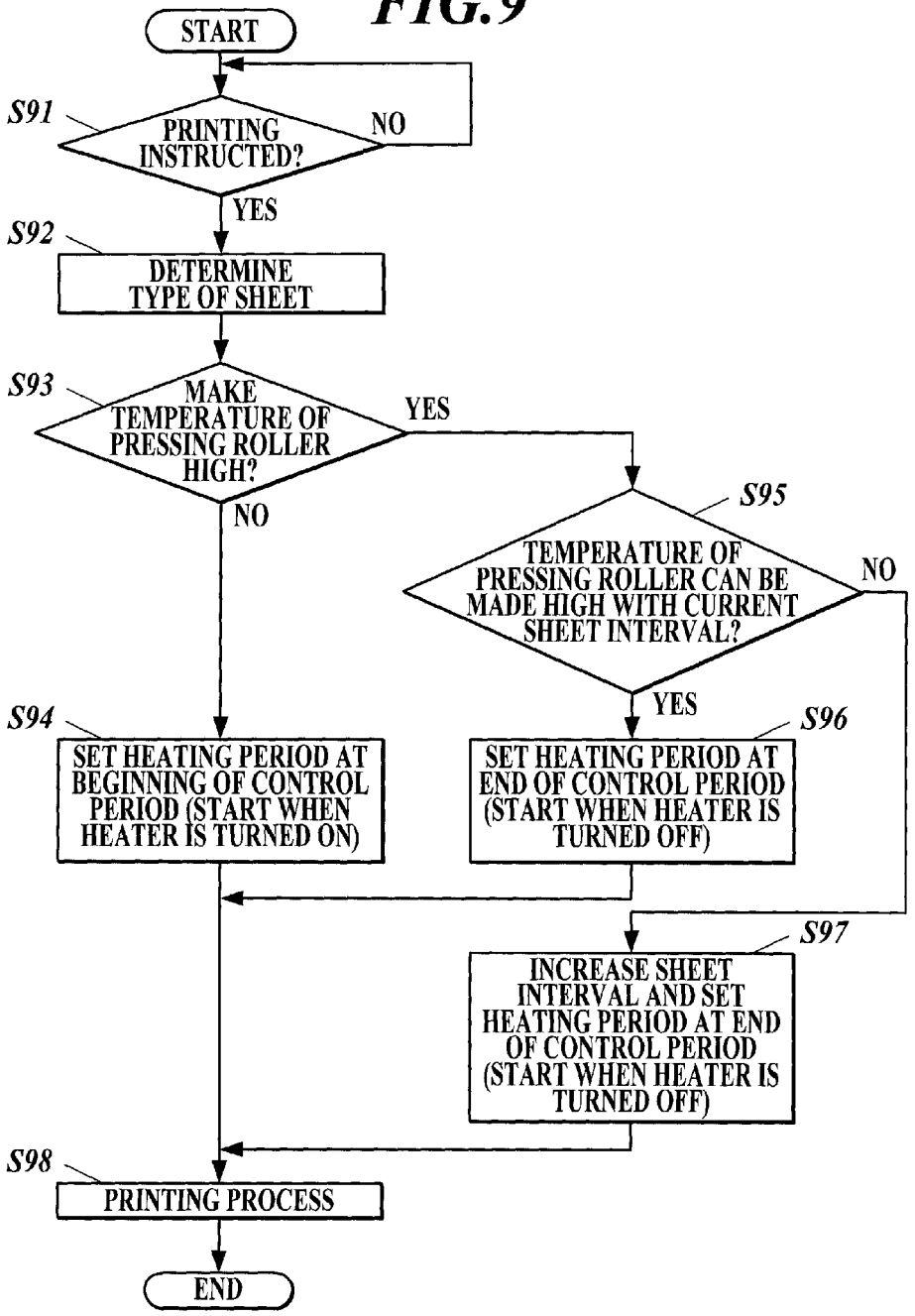
FIG. 9 is a flow chart showing an example of another operation of the image forming apparatus.

Even if the controller 10 sets the heating period at the end of the control period, there is a case where the temperature of the pressing roller does not become sufficiently high depending on the type of a sheet to be conveyed. In this case, although the productivity is reduced, amount of heat which directly propagates to the pressing roller 182 is made larger by increasing the sheet interval. FIG. 9 is a flowchart showing an operation in case where the sheet interval is increased in accordance with the type of a sheet to be conveyed.

In FIG. 9, since the Steps S91 to S 94 and S98 are the same as Steps S41 to S44 and S46, the explanation will be omitted.

As shown in FIG. 9, if the controller 10 determines that the temperature of the pressing roller 182 needs to be made high (Step S93: Yes), the controller 10 determines whether the temperature of the pressing roller 182 can be made high while maintaining the current sheet interval (Step S95).

If the controller 10 determines that the temperature of the pressing roller 182 can be made high while maintaining the current sheet interval (Step S95: Yes), the processor 10 sets a heating period at the end of the control period (Step S96) and shifts the processing to Step S98.

On the other hand, if the controller 10 determines that the temperature of the pressing roller 182 cannot be made high while maintaining the current sheet interval (Step S95: No), the processor 10 increases the sheet interval, sets a heating period at the end of the control period (Step S97) and shifts the processing to Step S98. Specifically, the controller 10 controls the conveyance velocity or the like of a sheet to increase the interval between the sheets (sheet interval) by controlling the conveyer 19 which is an adjusting unit.

When the sheet interval is increased in Step S97, apart of amount of heat which is necessary to be supplied to a sheet in an expected printing directly propagates to the pressing roller 182 and a resulting loss increases. The increase or decrease of the correction amount described above becomes not able to compensate the loss.

Therefore, the controller 10 adds lighting time correction amount to a heating period to compensate the loss of amount of heat in a sheet interval. When the sheet interval is increased, the lighting time correction amount is added to the heating period regardless of whether the control period starts when the heater is turned ON or the control period starts when the heater is turned OFF.

For example, as shown in FIG. 8B, when the state where the number of sheets to be printed is 40 (sheets/minute) and the sheet interval is 52.5 (mm) is changed to the state where the number of sheets to be printed is 40 (sheets/minute) and the sheet interval is 210.0 (mm), the lighting time correction amount is 14%. The lighting time becomes the sum of the heating period before the change and 14% of the lighting time correction amount.

When a sheet interval is decreased from a state where a sheet interval is increased in accordance with the type of sheet to be conveyed, corresponding lighting time correction amount only has to be subtracted from the heater lighting period.

As described above, when the controller 10 increases a sheet interval in accordance with the type of a sheet to be conveyed, by adding the light time correction amount to the heating period to set the heater lighting period, the loss caused by a part of amount of heat which needs to be supplied to a sheet in expected printing directly propagates to the pressing roller 182 can be compensated. Thus, the temperature of the pressing roller 182 can be properly controlled even if there is no heating unit on the pressing roller 182 side.

In the description of the embodiment, as shown in FIG. 5, the beginning of the control period is matched with the front edge of a sheet which arrives at the nip. However, the beginning of the control period is not necessarily matched with the front edge of a sheet.

Figure 10:
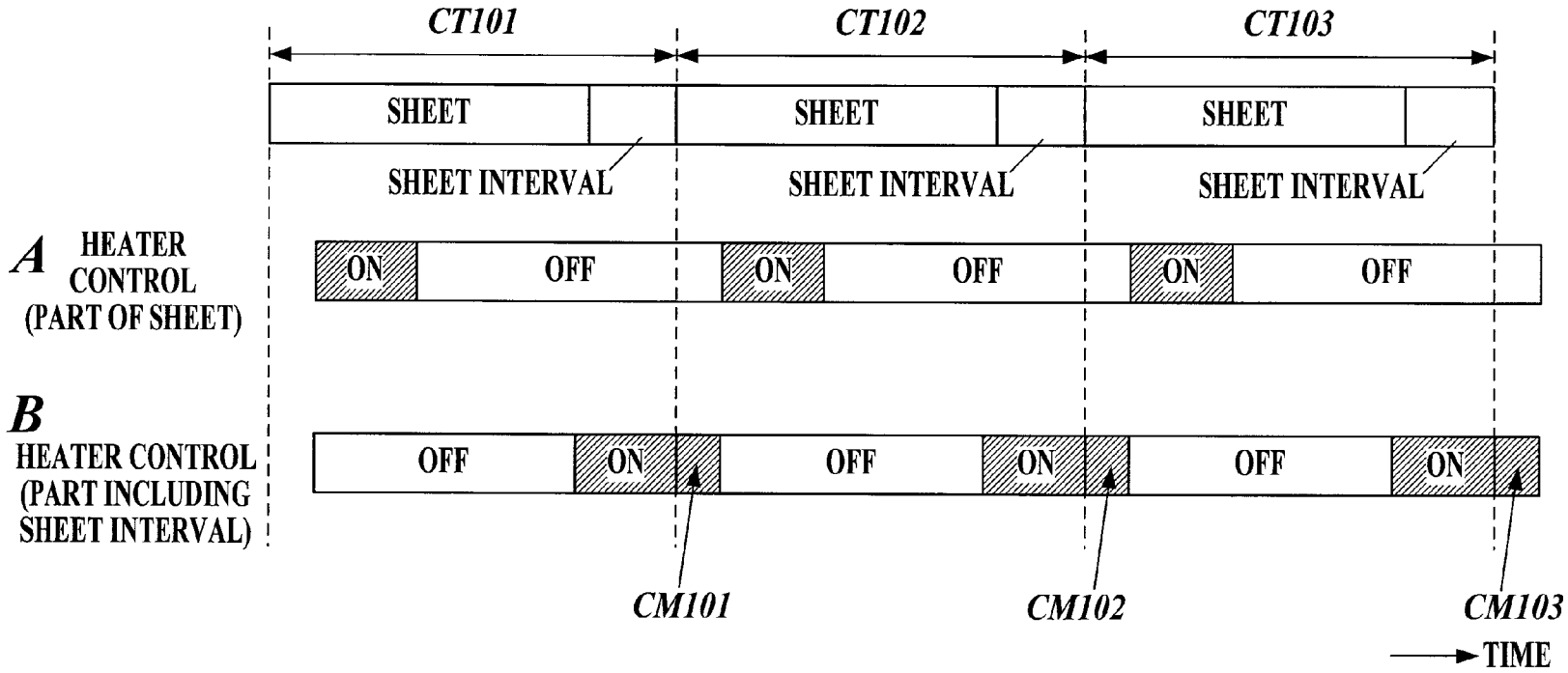
FIG. 10 is an explanatory view showing another example of heating control in the image fixing unit.

For example, as shown in FIG. 10, the heating period in the control period (e.g., control periods CT101, CT102, CT103) only has to be set in either (i) a period corresponding to a part of a sheet or (ii) a period including an interval between two sheets (sheet interval) in which the correction amounts CM101, CM102, CM103 are added to heating periods. That is, when a heating period is positioned in a period including a sheet interval, the temperature of the pressing roller 182 tends to easily increase in comparison to a case where a heating period is positioned in a period corresponding to a part of a sheet because the heat of the fixing belt 185 directly propagates to the pressing roller 182.

Figure 11:
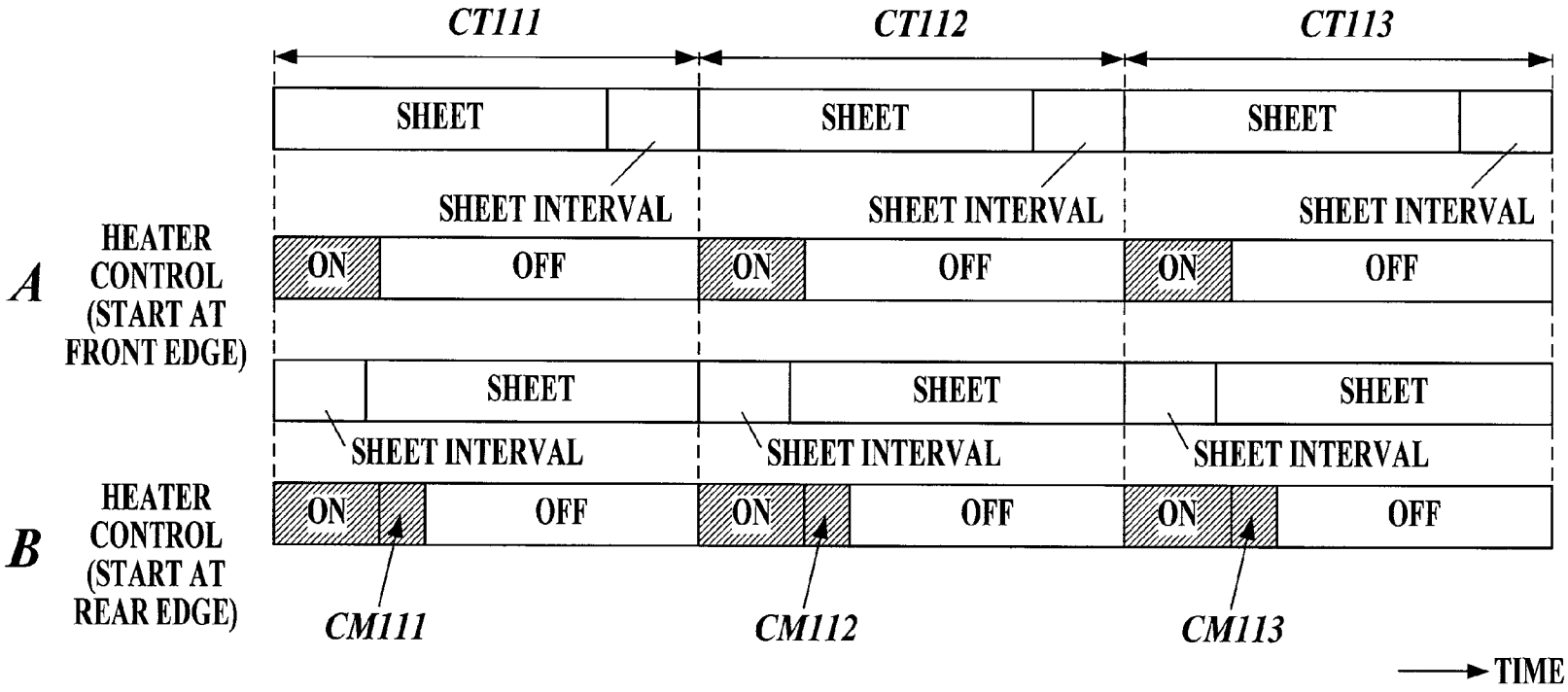
FIG. 11 is an explanatory view showing another example of heating control in the image fixing unit.

In the description of the embodiment, as shown in FIG. 5, the beginning of the control period is matched with the front edge of a sheet which arrives at the nip. However, the beginning of the control period may be matched with the rear edge of a sheet which arrives at the nip. For example, as shown in FIG. 11(B), the beginning of the control period (e.g., control periods CT111, CT112, CT113) may be matched with the rear edge of a sheet which arrives at the nip (with the addition of correction amounts CM111, CM112, CM113).

When the beginning of the control period is switched from the front edge of a sheet which arrives at the nip to the rear edge of the sheet, or when the beginning of the control period is switched from the rear edge of a sheet which arrives at the nip to the front edge of the sheet, since the two heat periods are provided in the same control period, an adjustment by skipping a heating period just after the switching or the like is necessary.

Figure 12:
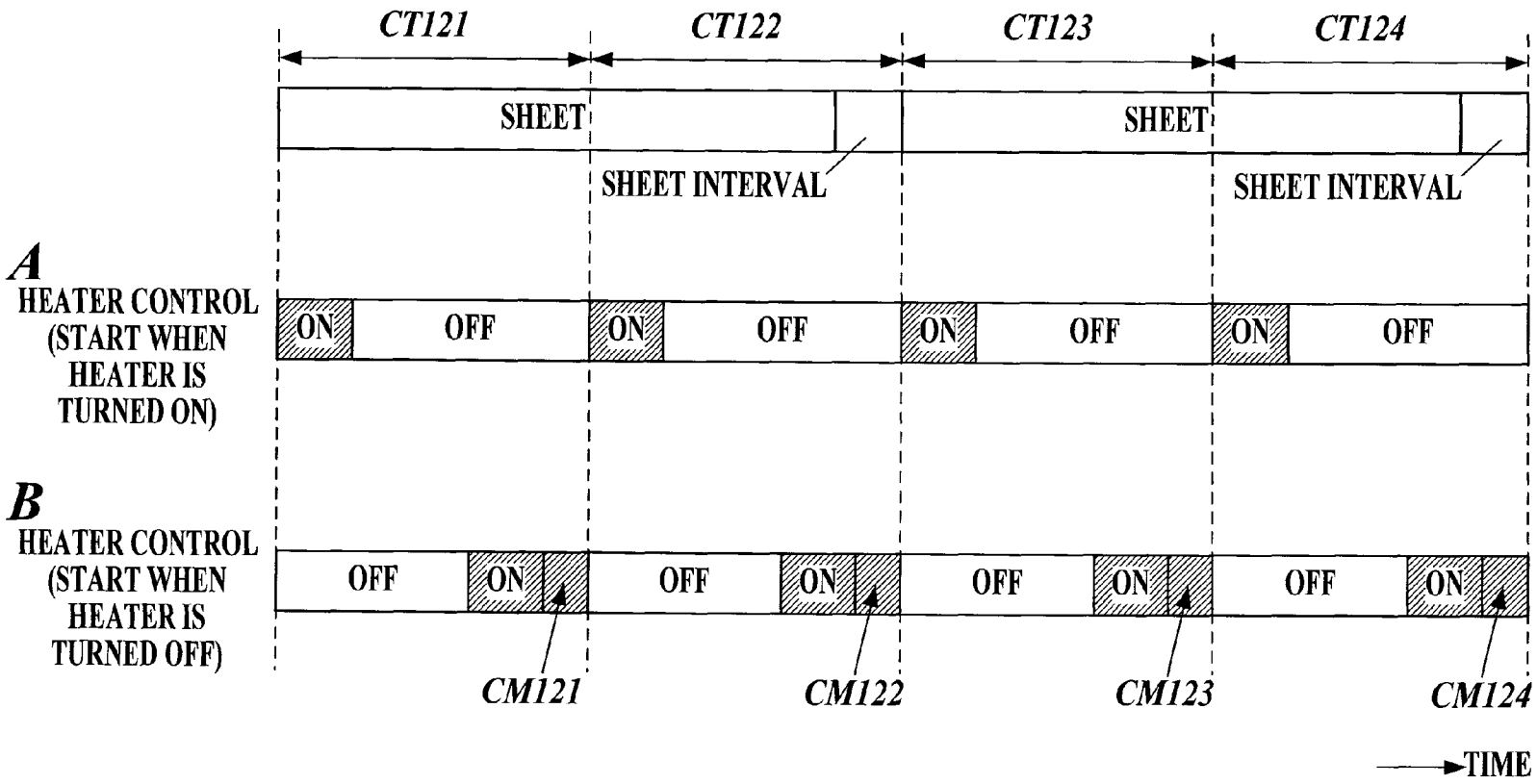
FIG. 12 is an explanatory view showing another example of heating control in the image fixing unit.

In the description of the embodiment, as shown in FIG. 5, the control period is the sum of the time during which the entire sheet passes through the nip and the time corresponding to the sheet interval. However, the control period may be the specified fraction of an integer of the sum of the time. For example, as shown in FIG. 12, the control period CT121, the control period CT122, the control period CT123 and the control period CT124 are one half of the sum of the time during which the entire sheet passes through the nip and the time corresponding to the sheet interval. As shown in FIG. 12B, correction amounts CM121, CM122, CM123 and CM124 are applied at the end of each control period.

Figure 13:
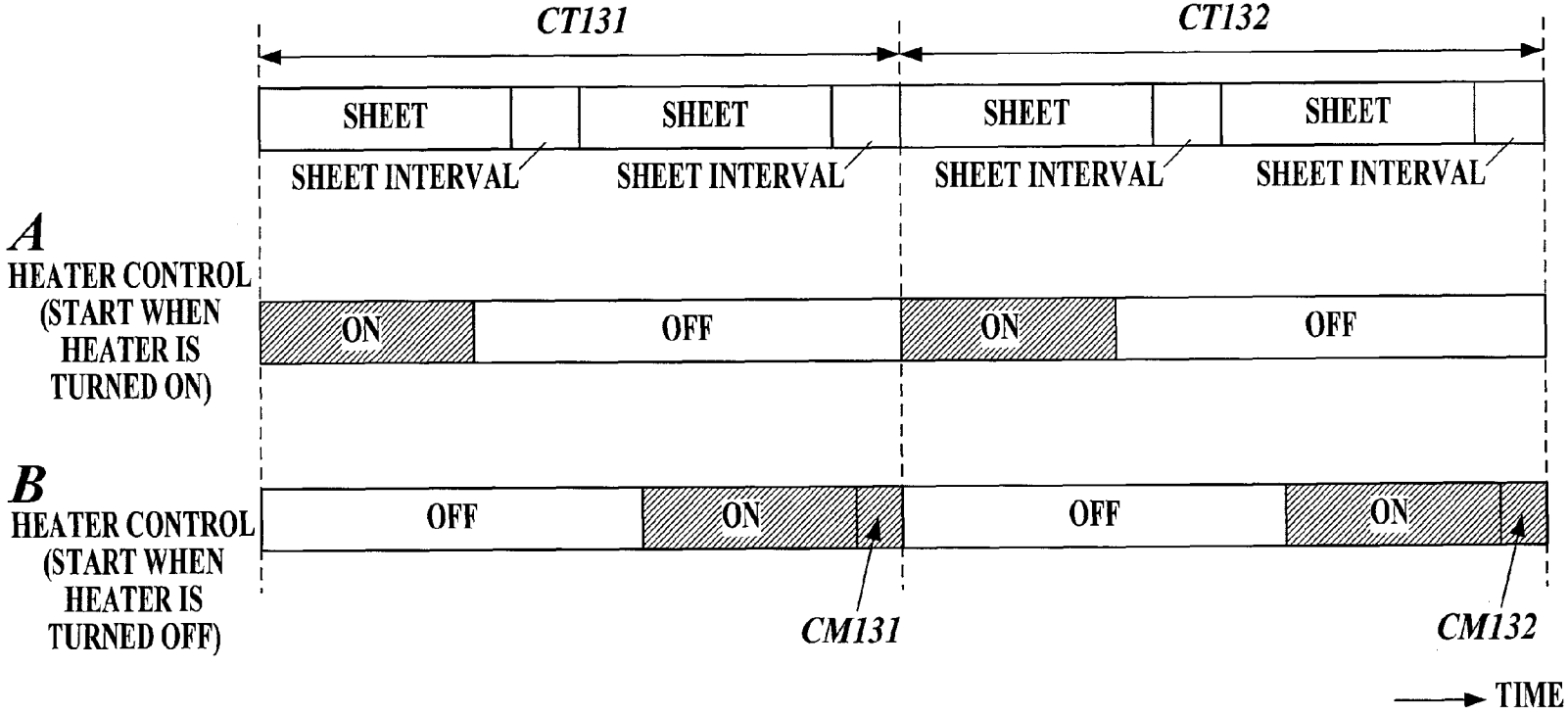
FIG. 13 is an explanatory view showing another example of heating control in the image fixing unit.

Similarly, the control period may be the integral multiple of the sum of the time during which the entire paper passes through the nip and the sheet interval. For example, as shown in FIG. 13, the control periods CT131 and CT132 are respectively twice as long as the sum of the time during which the entire sheet passes through the nip and the sheet interval. As shown in FIG. 13B, correction amounts CM131, CM132 are applied at the end of each control period.

In the description of the embodiment, in the fixing unit 18, the fixing belt 185 is stretched around the heating roller 183 and the fixing roller 181, and the fixing roller 181 and the pressing roller 182 forms a nip where the fixing belt 185 is sandwiched therebetween, the nip sandwiching and conveying a sheet. However, a fixing roller 181 including a halogen lamp heater 184 extending along the direction of axis of rotation of the fixing roller 181 and the pressing roller 182 may form a nip which sandwiches and conveys a sheet without using the heating roller 183 and the fixing belt 185. The pressing roller 182 may include the halogen lamp heater 184.

In the description of the embodiment, the image forming apparatus 1 is shown which includes an image forming unit for each of colors Y (Yellow), M (Magenta), C (Cyan), K (Black) and the like. However, this is an example and is not limitative. For example, the image forming apparatus may form a unicolor image.

In the description of the embodiment, the fixing roller 181 and the pressing roller 182 are described as separate configuration. However, the fixing roller 181 and the pressing roller 182 may be considered to be a pair of fixing members.

In according to one aspect of a preferred embodiment of the present invention, there is provided an image forming apparatus including: a fixing member which heats a toner image formed on a sheet; a pressing member which presses the sheet onto the fixing member; a heating unit which heats the fixing member; and a controller which controls the heating unit, wherein the sheet is located at the fixing member in a first period and the sheet is not located at the fixing member and the fixing member is located between sheets in a second period, and wherein the controller controls the heating unit such that the heating unit heats the fixing member in a first heating pattern in which a heating period does not include the second period or in a second heating pattern in which a heating period includes the second period.

In the image forming apparatus, the temperature of the pressing roller can be controlled even when there is not a heating unit on the pressing roller side.

The entire disclosure of Japanese Patent Application No. 2016-039512 filed on Mar. 2, 2016 is incorporated herein by reference in its entirety.

What is claimed is:

1. An image forming apparatus comprising:

a fixing member configured to heat a toner image formed on a sheet;

a pressing member configured to press the sheet onto the fixing member;

a heating unit configured to heat the fixing member; and a controller configured to control the heating unit to switch between a first heating pattern and a second heating pattern, wherein a control period includes (i) a first period in which the sheet is located at the fixing member, and (ii) a second period in which the sheet is not located at the fixing member, and the fixing member is located between a rear edge of a conveyed sheet and a front edge of a next conveyed sheet, and wherein the controller controls the heating unit such that (i) in the first heating pattern, the heating unit heats the fixing member in a first heating period that does not include the second period of the control period, and the fixing member is not heated in a period other than the first heating period of the control period or (ii) in the second heating pattern, the heating unit heats the fixing member in a second heating period that includes the second period of the control period, and the fixing member is not heated in a period other than the second heating period of the control period.

2. The image forming apparatus according to claim 1, wherein the controller controls the heating unit such that the heating unit heats the fixing member in the first heating pattern or in the second heating pattern in accordance with a type of the sheet.

3. The image forming apparatus according to claim 1, further comprising a temperature measurement unit which measures a temperature of the heating unit, wherein the controller controls the heating unit such that the heating unit heats the fixing member in the first heating pattern or in the second heating pattern in accordance with the temperature measured by the temperature measurement unit.

4. The image forming apparatus according to claim 1, wherein the first heating pattern is a heating pattern in which a heating period is set so as to perform heating from a time point when a front edge of the sheet arrives at the fixing member at a beginning of a control period composed of the first period and the second period, and the second heating pattern is a heating pattern in which a heating period is set so as to perform heating at an end of the control period.

5. The image forming apparatus according to claim 4, wherein the heating period is a period which lasts an integral multiple of the control period or a specified fraction of an integer of the control period.

6. The image forming apparatus according to claim 1, wherein the first heating pattern is a heating pattern in which a heating period is set so as to perform heating from a time point when a front edge of the sheet arrives at the fixing member at a beginning of a control period composed of the first period and the second period, and the second heating pattern is a heating pattern in which a heating period is set so as to perform heating from a time point when a rear edge of the sheet arrives at the fixing member.

7. The image forming apparatus according to claim 6, wherein when the controller performs switching of the beginning of the heating period from the time point when a front edge of the sheet arrives at the fixing member to the time point when a rear edge of a sheet arrives at the fixing member, or from the time point when a rear edge of a sheet arrives at the fixing member to the time point when a front edge of a sheet arrives at the fixing member, the controller skips the heating period just after the switching.

8. The image forming apparatus according to claim 1, comprising a fixing belt stretched around the fixing member and the heating unit, wherein the controller matches a position of the fixing belt where heating is started with a timing when the sheet is pressed between the fixing member and the pressing member.

9. The imaging forming apparatus according to claim 1, wherein, when the controller changes a set position of the heating period while fixing is performed, the controller compensates a change of the heating period.

10. The imaging forming apparatus according to claim 1, further comprising an adjusting unit which adjusts a conveyance interval between sheets, wherein the controller changes a duration of the second period by controlling the adjusting unit.

11. The imaging forming apparatus according to claim 10, wherein, when the controller changes the duration of the second period while fixing is performed, the controller compensates a change of the heating period.

12. A non-transitory computer readable medium storing a program thereon which makes a computer of an image forming apparatus function as a controller, the image forming apparatus including a fixing member which heats a toner image formed on a sheet; a pressing member which presses the sheet onto the fixing member; and a heating unit which heats the fixing member, wherein a control period includes (i) a first period in which the sheet is located at the fixing member and (i) a second period in which the sheet is not located at the fixing member and the fixing member is located between a rear edge of a conveyed sheet and a front edge of a next conveyed sheet, and wherein the controller controls the heating unit to switch between a first heating pattern and a second heating pattern such that (i) in the first heating pattern, the heating unit heats the fixing member in a first heating period does not include the second period of the control period, and the fixing member is not heated in a period other than the first heating period of the control period or (ii) in the second heating pattern, the heating unit heats the fixing member in a second heating period that includes the second period of the control period, and the fixing member is not heated in a period other than the second heating period of the control period.

13. The computer readable medium storing the program according to claim 12, wherein the program makes the computer function as the controller which controls the heating unit such that the heating unit heats the fixing member in the first heating pattern or in the second heating pattern in accordance with a type of the sheet.

14. The computer readable medium storing the program according to claim 12, wherein the image forming apparatus further comprises a temperature measurement unit which measures a temperature of the heating unit, and the program makes the computer function as the controller which controls the heating unit such that the heating unit heats the fixing member in the first heating pattern or in the second heating pattern in accordance with the temperature measured by the temperature measurement unit.

15. The computer readable medium storing the program according to claim 12, wherein the first heating pattern is a heating pattern in which a heating period is set so as to perform heating from a time point when a front edge of the sheet arrives at the fixing member at a beginning of a control period composed of the first period and the second period, and the second heating pattern is a heating pattern in which a heating period is set so as to perform heating at an end of the control period.

16. The computer readable medium storing the program according to claim 12, wherein the first heating pattern is a heating pattern in which a heating period is set so as to perform heating from a time point when a front edge of the sheet arrives at the fixing member at a beginning of a control period composed of the first period and the second period, and the second heating pattern is a heating pattern in which a heating period is set so as to perform heating from a time point when a rear edge of the sheet arrives at the fixing member.

17. The computer readable medium storing the program according to claim 15, wherein the heating period is a period which lasts an integral multiple of the control period or a specified fraction of an integer of the control period.

* * * * *